US008026861B2

(12) United States Patent
Kondou

(10) Patent No.: US 8,026,861 B2
(45) Date of Patent: Sep. 27, 2011

(54) SHIELDING DEVICE FOR VEHICULAR ELECTRONIC COMPONENTS

(75) Inventor: Syunji Kondou, Isehara (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 1230 days.

(21) Appl. No.: 11/702,357

(22) Filed: Feb. 5, 2007

(65) Prior Publication Data

US 2007/0182649 A1 Aug. 9, 2007

(30) Foreign Application Priority Data

Feb. 6, 2006 (JP) ..... 2006-028092

(51) Int. Cl.
*H01Q 1/32* (2006.01)
*H01Q 1/52* (2006.01)

(52) U.S. Cl. ..... 343/841; 343/713

(58) Field of Classification Search ..... 343/711, 343/713, 841
See application file for complete search history.

(56) References Cited

U.S. PATENT DOCUMENTS

| | | | | |
|---|---|---|---|---|
| 3,724,554 | A * | 4/1973 | Rupert et al. | 169/52 |
| 6,037,977 | A * | 3/2000 | Peterson | 348/148 |
| 6,118,410 | A * | 9/2000 | Nagy | 343/713 |

FOREIGN PATENT DOCUMENTS

| | | |
|---|---|---|
| CN | 2272850 | 1/1998 |
| JP | 04-090604 | 3/1992 |
| JP | 05-080883 | 4/1993 |
| JP | 2000048980 | 2/2000 |
| JP | 2000-136949 | 5/2000 |
| JP | 2001-185889 | 7/2001 |

* cited by examiner

*Primary Examiner* — Tan Ho
(74) *Attorney, Agent, or Firm* — Young Basile

(57) ABSTRACT

A shielding device for an electronic component for use in a vehicle. The electronic component is positioned on the vehicle and generates an electromagnetic wave. A conductive panel is positioned between the electronic component and an antenna and substantially covers the electronic component. A ground wire is connected to the conductive panel and the vehicle so as to establish a ground connection for the electromagnetic wave.

18 Claims, 6 Drawing Sheets

SHIELDING DEVICE FOR VEHICULAR ELECTRONIC COMPONENTS

CROSS-REFERENCE TO RELATED APPLICATION

This application claims priority from Japanese Patent Application Serial No. 2006-028092, filed Feb. 6, 2006, which is incorporated herein in its entirety by reference.

TECHNICAL FIELD

The present invention pertains in general to a shielding structure for electronic components used in vehicles.

BACKGROUND

There are known visual recognition devices in which a camera is provided on the outside of a vehicle so as to help a vehicle operator recognize conditions surrounding the vehicle with ease. For example, one such known rearview recognition device for a vehicle is proposed in Japanese Utility Model Publication No. 5-80883 where a camera is attached to a rear part of the vehicle. The conditions behind the vehicle are captured by the camera, and then the obtained images are displayed in the front of a vehicle within the vehicle operator's line of sight. With the captured image, the vehicle operator can reverse the vehicle with greater safety.

BRIEF SUMMARY OF THE INVENTION

One exemplary embodiment of the invention is a shielding device for use in a vehicle having an antenna and an electronic component generating an electromagnetic wave wherein the electronic component is mounted at least in part exterior to the vehicle. The shielding device comprises an exterior panel positioned between the electronic component and the antenna and having a property suitable for shielding the antenna from the electromagnetic wave.

According to another embodiment taught herein, an apparatus for use in a vehicle including an antenna comprises means for generating an electromagnetic wave and means for shielding the antenna from the electromagnetic wave. The generating means is mounted at least in part exterior to the vehicle, and the shielding means is positioned between the generating means and the antenna.

Embodiments of an electrically conductive panel for shielding electromagnetic waves generated by an electronic component attached to an exterior of a vehicle are also taught herein. The conductive panel comprises a resinous finisher sized to substantially cover the electronic component and a metal plating layer formed on a surface of the resinous finisher.

According to another embodiment taught herein, a vehicle comprises an electronic component mounted exterior to a trunk compartment, an antenna for receiving signals from outside of the vehicle and mounted higher than the electronic component in a vertical direction relative to the vehicle and a shielding device for shielding electromagnetic waves generated by the electronic component from the antenna. The shielding device includes an electrically conductive panel attached to the vehicle distant from the antenna and having an interior cavity housing the electronic component.

BRIEF DESCRIPTION OF THE DRAWINGS

The description herein makes reference to the accompanying drawings wherein like reference numerals refer to like parts through out the several views and wherein.

DETAILED DESCRIPTION OF EMBODIMENTS OF THE INVENTION

Known vehicular visual recognition devices have, for example, been used for seeing objects located behind a vehicle to alert a driver to things not readily observed through rear or side view mirrors. These known devices have included an electronic component, typically a charge-coupled device camera or CCD to optically pick up the object for viewing by a display device observable by the driver. The camera is typically mounted in a recess in a rear panel of a vehicle, for example, the trunk compartment lid or decklid of the vehicle. The CCD or other cameras typically emit electromagnetic waves.

On the other hand, the vehicle is further equipped with an antenna for receiving radio wave or receiving data for a vehicle navigation system. When the antenna receives electromagnetic wave generated by the CCD camera, there can arise a problem wherein a radio or the vehicle navigation system produces noise as a result, thereby interfering with a normal operation of the radio or the vehicle navigation system.

According to an embodiment of the invention, a shielding device or structure is used to block or significantly reduce propagation or transmission of such electromagnetic waves caused by a camera to prevent or reduce reception of such waves by an antenna, thereby eliminating or reducing interference or noise in the use of other vehicular electronics such as radios and vehicle navigation systems.

In the shielding structure taught herein, the shielding structure is used to completely shield or at least substantially block the electromagnetic waves generated by an electronic component, for example, a charged-coupled device camera, that may be mounted to the rear of a vehicle. In one example of a shielding device taught herein, the shield includes a conductive panel covering the electronic component and positioned between the electronic component and the antenna used for radio or vehicle navigation devices. A ground wire can be connected to the conductive panel and the vehicle body structure establishing a ground connection for the electromagnetic waves produced by the camera.

Figure 1:
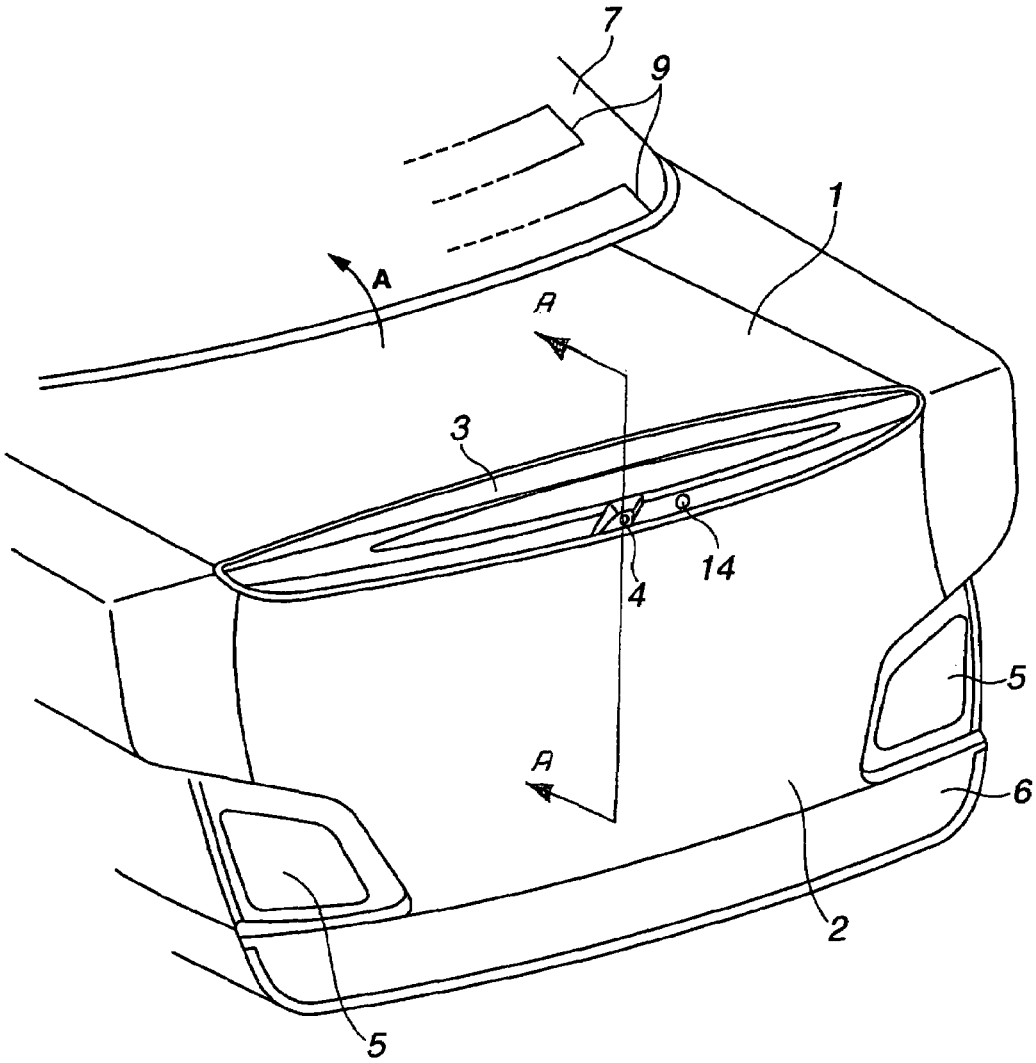
FIG. 1 is a perspective view of a rear part of a vehicle showing an example of the shielding device.

Referring now to FIGS. 1-7, FIG. 1 is a perspective view of a rear part of a vehicle. As shown in FIG. 1, a trunk compartment lid 1 is attached to the rear part of the vehicle. The trunk lid 1 has a rearward extending portion connected to a rear end panel 2 that constitutes a rear wall partially enclosing the trunk compartment 8. The trunk lid 1 and the rear end panel 2 may generally be disposed perpendicular to each other thereby forming a corner area where they meet. The corner area is equipped with a conductive panel serving as an electromagnetic wave-blocking member. Additionally, when the trunk lid is opened, that is, when the trunk lid 1 is pivotally moved around a hinge (not shown) and located at a forward end of the trunk lid 1 in a rotational direction A, the conductive panel 3 is pivotally moved in the same direction together with the rear end panel 2.

In an embodiment, the conductive panel 3 is entirely formed of resin (hereinafter also referred to as resinous finisher 3) and equipped with an optical viewing device, for example, camera 4 near its center. The resinous finisher 3 may serve as a functional or decorative rear spoiler positioned on the trunk lid 1 as generally shown. It is understood that the conductive panel 3 may be made from materials other than resin as known by those skilled in the art. An optical axis of a lens mounted in the CCD camera 4 is directed rearward and diagonally downward with respect to the vehicle. Further, members illustrated by reference numerals 5, 6 and 7 in FIG. 1 are rear combination lamps, a rear bumper and a rear window, respectively.

Figure 2:
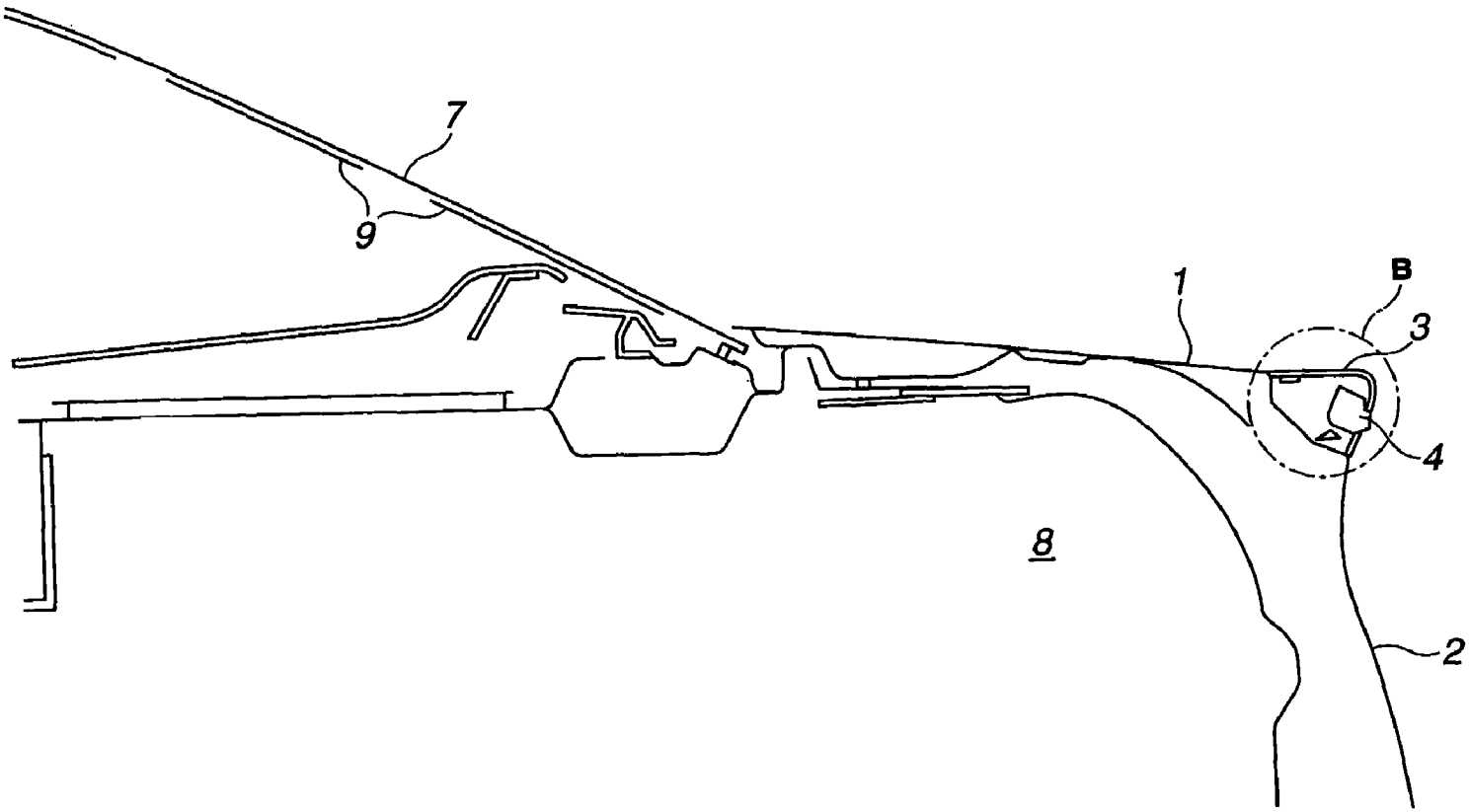
FIG. 2 is a sectional view of the rear part of the vehicle in FIG. 1 taken along line A-A and including an example CCD camera.

FIG. 2 is a longitudinal sectional view of the rear part of the vehicle taken along line A-A in FIG. 1. As shown in FIG. 2, the trunk compartment 8 is enclosed by the trunk lid 1, the rear end panel 2 and other adjacent vehicular body panels. As shown in FIGS. 1 and 2, the rear window 7 is disposed on the side of the forward end of the trunk lid 1 and equipped with a radio wave-receiving antenna 9 on its inside surface.

Figure 3:
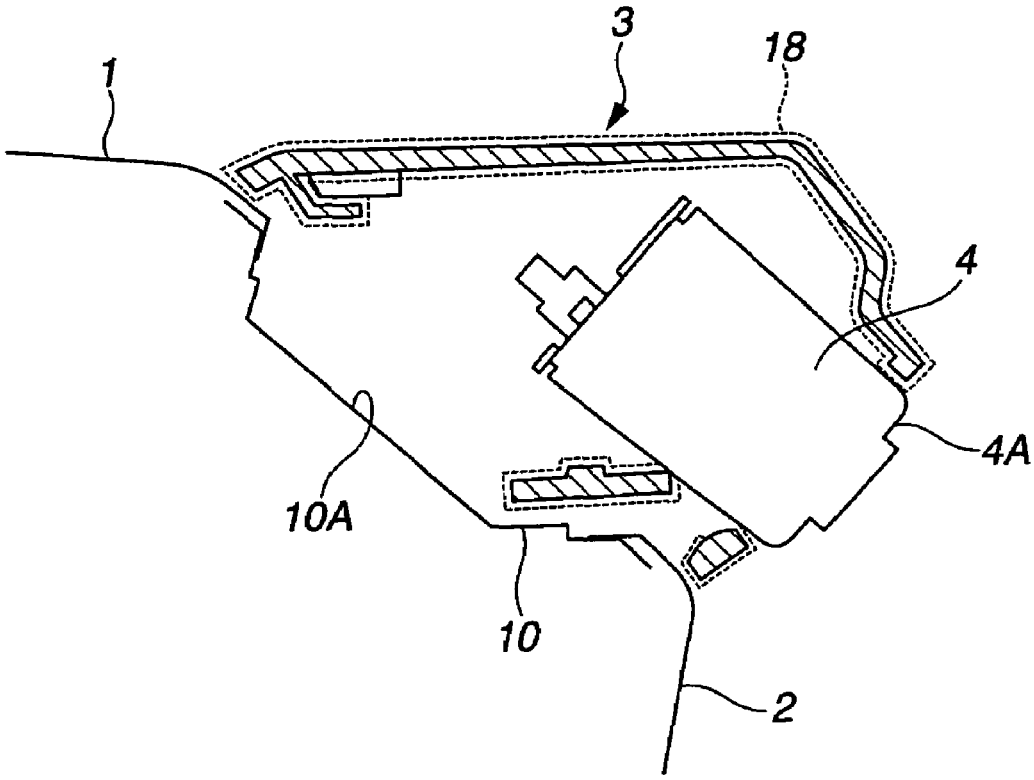
FIG. 3 is an enlarged sectional view of a portion illustrated within zone B in FIG. 2.

FIG. 3 is an enlarged sectional view of a portion illustrated within a zone B in FIG. 2. The rear end section of the trunk lid 1 and an upper end section of the rear end panel 2 are connected to each other by a connecting panel 10 oriented on an incline. The connecting panel 10 is formed with a depression 10A at its center. The resinous finisher 3 includes a first end positioned toward the connecting panel 10 and a second end opposite the first end adjacent the rear of the vehicle. The resinous finisher 3 is positioned and attached so as to cover the depression 10A of the connecting panel 10 at its first end. The camera 4 has an end surface 4A housing the camera lens. As shown in FIG. 3, in this embodiment the resinous finisher 3 exposes only camera surface 4A. The other portions of the camera 4 are entirely housed in the resinous finisher 3.

Figure 4:
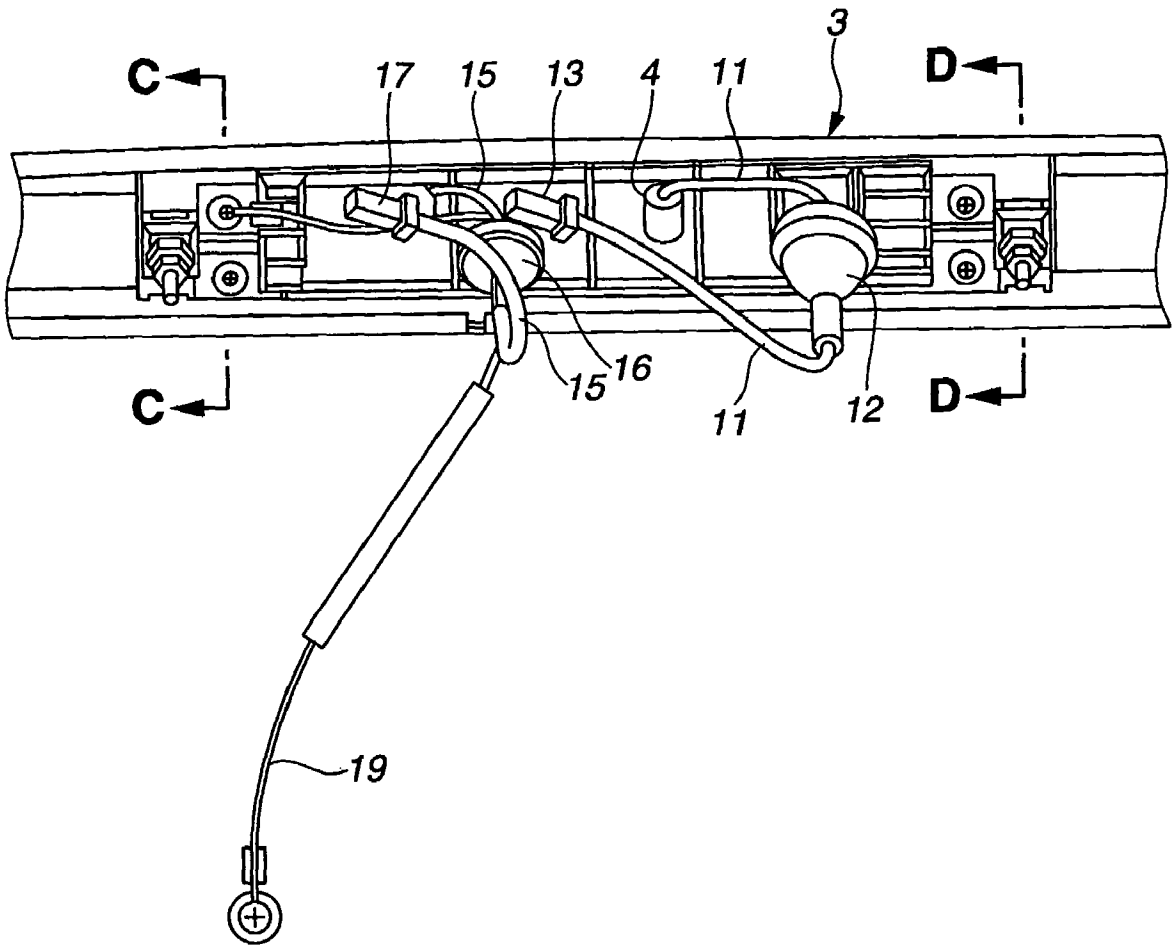
FIG. 4 is a partial view of a resinous finisher to which the example CCD camera is attached as viewed looking toward the rear of the vehicle.
Figure 5:
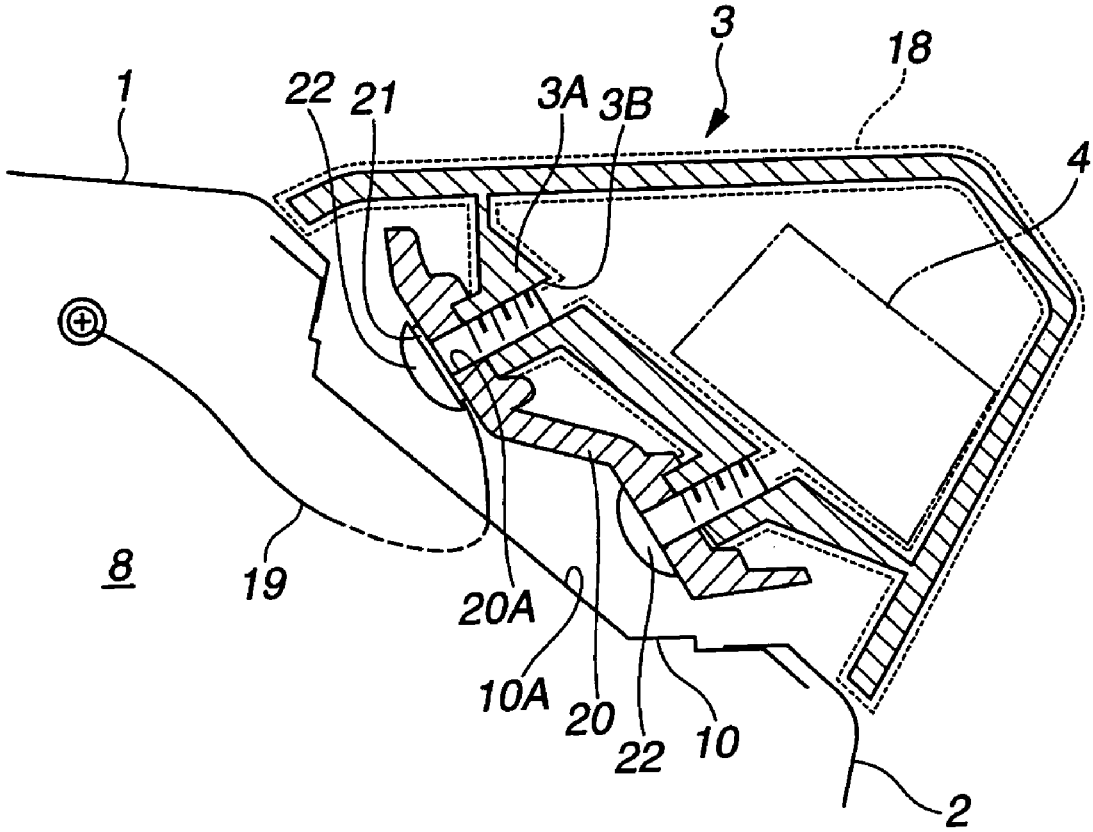
FIG. 5 is a sectional view taken generally along a plane indicated by line C-C in FIG. 4.
Figure 6:
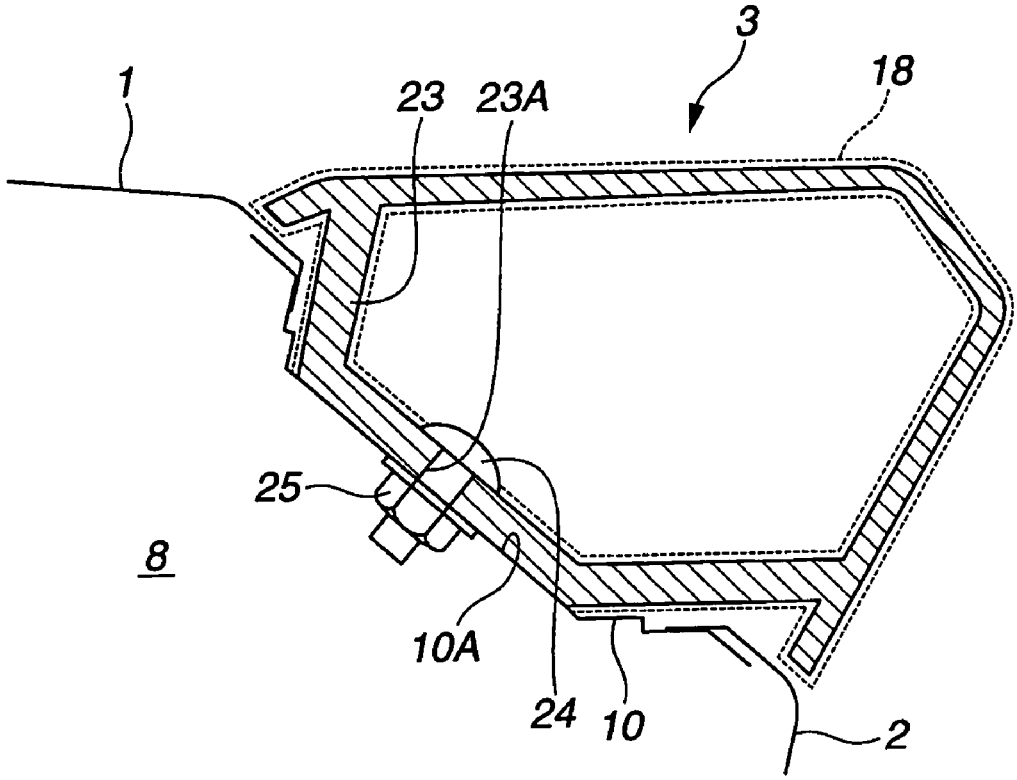
FIG. 6 is a sectional view taken generally along a plane indicated by line D-D in FIG. 4.

FIG. 4 is a partial view of the resinous finisher 3 to which the camera 4 is attached as viewed looking toward the rear of the vehicle from the front of the vehicle. FIGS. 5 and 6 are sectional views of the resinous finisher 3 as typically positioned and installed to the rear part of the vehicle, taken generally along lines C-C and lines D-D in FIG. 4, respectively.

Camera 4 is provided with a signal cable 11 for transmitting an image signal to an in-car microprocessor (not shown). As shown in FIG. 4, the signal cable 11 is disposed extending toward the trunk compartment 8 through a grommet 12 and has an end portion to which a connector 13 is attached. The grommet 12 is positioned and installed in a through-hole in the connecting panel 10.

As shown in FIG. 1, the resinous finisher 3 is further provided with an open button or switch 14 used by an operator to open the trunk lid 1. The open switch 14 is a switch adapted to electrically open the trunk when pushed. A control signal cable 15 is connected to the open switch 14. The control signal cable 15 is disposed extending toward the trunk compartment 8 through a grommet 16 and has an end portion to which a connector 17 is attached. The grommet 16 is positioned and installed in a through-hole (not shown) in the connecting panel 10.

In this embodiment, metal plating 18 is applied on the entire surface (i.e., an inner surface and an outer surface) of the resinous finisher 3 as shown in FIGS. 3, 5 and 6. In this embodiment, the entire surface of the resinous finisher 3 is coated with a metal plating layer 18, which serves as a shielding material. The metal plating layer 18 is preferably a triple-layer structure including a chromium plating layer and a nickel plating layer that are high in hardness and brightness and excellent in corrosion resistance, and a copper plating layer with excellent macrothrowing power and ability to protect a base metal. The metal plating layer 18 is preferably formed such that the chromium, nickel and copper plating layers are arranged in the order mentioned, from the exterior toward the resinous finisher interior subtrate or wall forming a conductive exterior panel. It is understood that other plating materials and layer structures may be used as known by those skilled in the art. It is further understood that other deposits of metal, for example, metal molded into portions of the resinous finisher, are contemplated as an alternate embodiment.

A ground connection is established in this embodiment between the resinous finisher 3 and the vehicle body. One side of a ground wire 19 is connected to the resinous finisher 3. The other side of the ground wire 19 is disposed extending toward the trunk compartment 8 through the grommet 16 and connected at its end portion to a metal panel. For example, the metal panel could be, as shown in FIG. 5, an inner conducting wall or panel of the trunk compartment 8.

Figure 7:
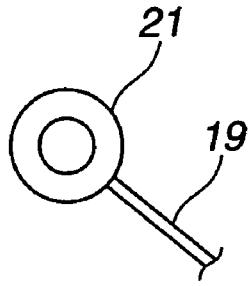
FIG. 7 is a plan view of an end portion of a ground wire.

In this embodiment, one side of the ground wire 19 is connected to the resinous finisher 3 as follows. As shown in FIG. 5, the resinous finisher 3 has an inner wall member 3A to which a bracket 20 is joined. The inner wall member 3A and the bracket 20 are formed with through holes 3B and 20A, respectively. A metal washer 21 (as also shown in FIG. 7) is attached to an end portion of one side of the ground wire 19. A metal threaded fastener, for example tapping screw 22, is inserted into the metal washer 21 and the through hole 20A of the bracket 20 and then screwed into the through hole 3B of the inner wall member 3A. The one side of the ground wire 19 is thus securely connected to the resinous finisher 3.

As discussed above, metal plating 18 is preferably deposited on the entire surface of the resinous finisher 3. When the one side of the ground wire 19 is connected to the resinous finisher 3 by using the metallic tapping screw 22, the metal plating layer 18 formed on the resinous finisher 3 is electrically connected to the vehicle when the other end of ground wire 19 is connected to a metal body panel in the trunk compartment 8 through another body tapping screw 22 and metal washer 21.

As shown in FIG. 6, the resinous finisher 3 further has at least one rib 23 inside. The rib 23 is formed and orientated to fit in the depression 10A of the connecting panel 10. Rib 23 is formed with a through hole 23A. A screw or other fastener 24 is inserted into the through hole 23A of the rib 23 and threadedly engaged with a nut 25 disposed on the opposing side of the connecting panel 10 toward the truck compartment 8. With this, the resinous finisher 3 is securely attached onto the connecting panel 10.

In this embodiment, the resinous finisher 3 is entirely plated with metal on its surface and surrounds the camera 4. The ground connection is established through the ground wire 19 between the resinous finisher 3 and the vehicle body. With this construction, even if electromagnetic waves are generated by the camera 4 during operation, the radio wave-receiving antenna 9 is shielded from receiving the electromagnetic waves. As a result, a radio or vehicle navigation system is protected from noise from the camera or other electronic component.

The above-mentioned arrangement does not introduce additional parts for shielding electromagnetic waves. The electromagnetic wave is blocked by metal plating on the resinous finisher 3, which has the added benefit of improving the appearance of the spoiler so that the arrangement is inexpensively achieved without increasing the cost.

Further, the camera 4 is disposed at the upper end section of the rear end panel 2, so that the camera is less noticeable from the vehicle exterior versus the high visibility where the camera 4 is near a license plate or an upper end part of a rear door.

When it is desired that the ground connection not be established, the resinous finisher 3 itself can work as an antenna because of the metal plating formed thereon. This device potentially produces noise in the radio or the vehicle navigation system. In the disclosed inventive embodiment in which the ground connection is established between the resinous finisher 3 and the vehicle body through the ground wire 19, there is no or a substantially decreased opportunity for noise production by the electrical component or camera 4.

According to the above-mentioned embodiment, the metal plating layer 18 is so formed as to include the chromium plating layer at its outermost surface, and the nickel and copper plating layers inside or underneath the chromium plating layer. With this arrangement of layers, the tapping screw 22 effectively peels the chromium plating layer (which is poor in conductivity) off when screwed into the metal plating layer 18 and then makes electrical contact with the nickel and copper plating layers (which are excellent in conductivity). This makes the ground connection between the metal plating layer 18 and the vehicle body more reliable. Furthermore, this does not require an additional process of preliminarily removing the chromium plating layer off in these local areas, thereby contributing to the cost reduction benefits.

Also, the above-described embodiments have been described in order to allow easy understanding of the present invention and do not limit the present invention. On the contrary, the invention is intended to cover various modifications and equivalent arrangements included within the scope of the appended claims, which scope is to be accorded the broadest interpretation so as to encompass all such modifications and equivalent structure as is permitted under the law.

For example, the metal plating may be made only on an outer surface of the resinous finisher 3 and an outer surface of the inner wall member 3A.

The invention can also be applied to other cameras or optical devices other than a CCD camera and can be positioned in other areas around the vehicle such as the sides, top or beneath the vehicle. As an example, herein the resinous finisher 3 and its conductive surface 18 are mounted to a spoiler or form a spoiler mounted to the trunk compartment lid 1. However, the resinous finisher 3 could be mounted to the trunk compartment lid 1 directly or form the trunk compartment lid 1. In this case, the camera 4 would be mounted in part in the trunk compartment lid. The conductive surface 18 could cover part or all of the trunk compartment lid 1.

Furthermore, the present invention can be applied to any other electronic components as an alternative to the above-discussed embodiment where the camera 4 is employed as the electronic component.

What is claimed is:

1. A shielding device for use in a vehicle having an antenna and an electronic component generating an electromagnetic wave, the electronic component mounted at least in part exterior to the vehicle, the shielding device comprising:

an exterior panel positioned between the electronic component and the antenna and having a property suitable for shielding the antenna from the electromagnetic wave, wherein the exterior panel is an electrically conductive exterior panel at least partially enclosing the electronic component.

2. The shielding device according to claim 1, further comprising:

a ground wire connected to the conductive panel and the vehicle and establishing a ground connection for the electromagnetic wave.

3. The shielding device according to claim 2 wherein the conductive panel is attached to the vehicle by a fastener and the ground wire attached to the conductive panel by the fastener.

4. The shielding device according to claim 1 wherein the exterior panel comprises a resinous finisher having a metal plating layer coating an outer surface of the resinous finisher.

5. The shielding device according to claim 4 wherein the metal plating layer comprises a multi-layer structure having a chromium plating outer layer and at least one of a nickel plating layer and a copper plating layer positioned between the chromium layer and the resinous finisher.

6. The shielding device according to claim 1 wherein the conductive panel comprises a trunk compartment lid.

7. The shielding device according to claim 1 wherein the conductive panel comprises a rear spoiler.

8. An apparatus for use in a vehicle including an antenna, comprising:

means for generating an electromagnetic wave, the generating means mounted at least in part exterior to the vehicle; and means for shielding the antenna from the electromagnetic wave, the shielding means positioned between the generating means and the antenna, wherein the shielding means comprises:

a resinous finisher; and a metal plating layer formed on a surface of the resinous finisher.

9. The apparatus according to claim 8 wherein the metal plating layer comprises multi-layer plating having a chromium plating layer and at least one of a nickel plating layer positioned between the chromium layer and the resinous finisher.

10. The apparatus according to claim 8 wherein the resinous finisher is at least a portion of a vehicle exterior trunk compartment lid.

11. The apparatus according to claim 8 wherein the resinous finisher is at least a portion of a vehicular rear spoiler.

12. A vehicle, comprising:

an electronic component mounted exterior to a trunk compartment;

an antenna for receiving signals from outside of the vehicle and mounted higher than the electronic component in a vertical direction relative to the vehicle; and a shielding device for shielding electromagnetic waves generated by the electronic component from the antenna, the shielding device including an electrically conductive panel attached to the vehicle distant from the antenna and having an interior cavity housing the electronic component.

13. The vehicle according to claim 12 wherein the electrically conductive panel comprises an interior component and metal plating substantially covering an outer surface of the interior component.

14. The vehicle according to claim 13 further comprising:

a grounding member attached to the metal plating and to an inner conductive panel of the vehicle.

15. The vehicle according to claim 12 wherein the metal plating further comprises a first layer of at least one of a layer of nickel and a layer of copper positioned over the outer surface of the interior component and a layer of chromium positioned over the first layer.

16. The vehicle according to claim 12 wherein the electrically conductive panel includes a first end attached to a lid of the trunk compartment and a second end opposite the first end adjacent to the rear of the vehicle, the second end defining an opening for protrusion of a selective portion of the electronic component to pass through the outer surface of the electrically conductive panel.

17. The vehicle according to claim 12 wherein the electronic component is a CCD camera including a lens, and wherein the electrically conductive panel substantially encloses the CCD camera and the lens is positioned with respect to the electrically conductive panel such that the lens is directed away from the rear of the vehicle to capture images of the environment behind the vehicle.

18. The vehicle according to claim 12 wherein the electrically conductive panel includes a lid of the trunk compartment.

* * * * *